US006578397B1

(12) United States Patent
Altrich et al.

(10) Patent No.: US 6,578,397 B1
(45) Date of Patent: Jun. 17, 2003

(54) COMBINED SMALL OBJECT-ASSIST DEVICE

(76) Inventors: Lawrence Altrich, 16 Princeton Ave., Waltham, MA (US) 02451; Henry G. LaShoto, 131 Doty St., Waltham, MA (US) 02452; Louis J. Foreman, 15735 Delancey La., Huntersville, NC (US) 28078

( * ) Notice: Subject to any disclaimer, the term of this patent is extended or adjusted under 35 U.S.C. 154(b) by 0 days.

(21) Appl. No.: 10/117,820

(22) Filed: Apr. 8, 2002

(51) Int. Cl.[7] ..... E05B 19/04; A41F 1/02; A44B 1/18

(52) U.S. Cl. ..... 70/408; 70/456 R; 24/40

(58) Field of Search ..... 70/408, 456 R; 24/40; 294/3.6; 223/111, 112, 113, 114, 115, 116, 117, 118

(56) References Cited

U.S. PATENT DOCUMENTS 1,084,399 A * 1/1914 Collins ..... 24/40
3,017,680 A * 1/1962 Duncan ..... 294/3.6
4,067,487 A 1/1978 Carr et al.
4,942,646 A 7/1990 Sebastian
5,100,191 A 3/1992 Detrick et al.
5,207,082 A * 5/1993 LeMaitre ..... 70/408
5,347,688 A * 9/1994 Ross ..... 24/40
5,500,966 A 3/1996 Wheat
5,623,844 A 4/1997 Draeger
5,671,624 A * 9/1997 Sivils ..... 70/408
5,732,447 A 3/1998 Nolan et al.
5,737,951 A 4/1998 Krass
5,794,471 A 8/1998 Rizzo
6,089,060 A * 7/2000 Steeley ..... 70/456 R
6,112,958 A 9/2000 Lamacchia
6,164,102 A 12/2000 Gapco
6,233,987 B1 * 5/2001 Ueno et al. ..... 70/408

* cited by examiner

*Primary Examiner*—Anthony Knight
*Assistant Examiner*—Michael J. Kyle
(74) *Attorney, Agent, or Firm*—Glasgow Law Firm, PLLC

(57) ABSTRACT

A small object-assistance device including a combination key/button/zipper assist device having a button/zipper assist device that releasably engages a key assist device thereby forming a multi-functional small-object assistance device. Also, methods for using the multi-functional small-object assistance device.

6 Claims, 5 Drawing Sheets

COMBINED SMALL OBJECT-ASSIST DEVICE

CROSS-REFERENCE TO RELATED APPLICATIONS

This nonprovisional utility patent application claims the benefit of one or more prior filed co-pending nonprovisional applications; a reference to each such prior application is identified as the relationship of the applications and application number (series code/serial number): The present application is a Continuation-In-Part of application Ser. No. 10/109,359 entitled "Key Turning Assist Device" filed Mar. 28, 2002, which is incorporated herein by reference in its entirety; the present application is also related to Ser. No. 10/118,345 entitled "Small Object Assist Device" filed on the same date herewith, which is also incorporated herein by reference in its entirety.

BACKGROUND OF THE INVENTION (1) Field of the Invention

The present invention relates generally to assistance devices for arthritic individuals and, more particularly, to a combined small object-manipulation assist device for operating keys, buttons and zippers and a method for using same.

(2) Description of the Prior Art

Many persons have ailments that affect their ability to use their hands. An estimated 43 million Americans suffer from arthritis and other similar conditions, and each year one million new patients develop arthritis. According to the US Centers for Disease Control and Prevention, an estimated 60 million people in the US will have arthritis by 2020. The largest component of the target market is individuals 65 or older. Also it is well documented that younger people comprise half of all people affected. There are also an estimated 250,000 children in the US who have arthritis. It is estimated that one million new patients are developing arthritis each year in the US. Arthritis is the main cause of activity limitation in the United States, and as a result, sufferers are quick to purchase any remedy or device that will help eliminate discomfort or maintain independence. It is believed that an estimated 10 billion dollars is spent yearly in the US on unproven arthritis remedies alone. Other ailments that affect an individual's capacity to manipulate small objects include carpal-tunnel syndrome, Charcot-Marie-Tooth disease, wrist and forearm fractures, birth defects, amputees, wearing casts, multiple sclerosis, muscular dystrophy, cerebral palsy, quadriplegia, etc., as well as the side effects of many medications that cause the loss of the sensation of touch and/or grip strength.

Thus, persons with such ailments or side effects from medication need devices to facilitate key-turning, zippering and buttoning. Often it is quite difficult for individuals with ailments affecting the hands to grip and operate smaller objects such as many modern keys having relatively small heads, zippers, and buttons. In the case of the elderly and for some children as well, many have limited hand dexterity that results in difficulty in holding and/or grasping objects. Such limited hand dexterity also leads to reduced ability of such individuals to pick up, manipulate and exert force on small objects. The action of pinching a key head, a zipper, or a button and manipulating the same small object may be painful, awkward or even impossible to perform. As a result there exists a need for a device to help these persons with manipulating small objects such as keys, buttons and zippers.

For example, in the case of keys, a majority of door locks and ignition system locks involve inserting a key into a keyhole and turning the key. This includes locks for doors of homes, offices, vehicles and other applications. Keys are well known in the security industry and are normally flat-bodied/planar/laminal and elongated devices, with the length being longer than the width. The shank of the key is the longer component and contains cut-out components, a series of irregularities such as teeth, and grooves on the shank configured to contact and correspond to various mating elements, pins and tumblers of the core of a cylinder lock, with the result that rotating the inserted key rotates the lock core to its desired location. The head of the key or also base of the key is an extension of the shank and is an enlarged component of same, such that a person using the key can manually hold the key-head, insert the shank into the keyhole, and exert torque on the head, thus completing the operation of unlocking a door or actuating an ignition switch. Generally the planar form of the key head is not chosen primarily for ease of use but to enable inexpensive manufacture, coding and compact storage of several keys on a single key ring.

Arthritis and a variety of other physical ailments and medications with side effects can reduce the ability of a key user to exert sufficient torque on a key in order to rotate a lock cylinder, the ability of a person to grasp and manipulate a zipper to open or close an opening, the ability of a person trying to manipulate a button to grasp the button properly and insert it through a button-hole.

Prior art commonly employs a number of small object-manipulation assist devices for the purpose of assisting persons who have difficulty handling small objects.

In the case of keys, prior art key-turning assist devices come in a variety of designs and styles having various names such as "Key Turner", "EZ Key," "EZ Key Turner", "Hand Key", and "Carpal Turn Key".

U.S. Pat. No. 5,623,844 to Richard L. Draegar describes a key leverage extending apparatus and method for assisting in the operation of a key in a lock. It provides for a leverage extender having a base member comprising a pair of opposed ends secured to a pair of opposed sides and a pair of opposed tops secured respectively to the opposed ends and the opposed sides such that there is a longitudinal aperture formed in between. A handle member is secured to one of the opposed sides, comprising an angular disposition relative to a plane of the base and having handle sides thereof parallel to the opposed sides. At least one set screw aperture is disposed in one of the opposed sides and is adapted to threadably receiving a set screw. A set screw member is threadably disposed in the set screw aperture. The apparatus is secured to flanges of a lock cylinder and a key is passed between the top members of the leverage extender and into the lock cylinder. Force is then applied to the handle member to operate the lock cylinder. Alternatively, a head of the key is secured to the leverage extender, and the key/leverage extender combination is disposed in the lock to subsequently turn the handle member of the leverage extender and operate the lock.

U.S. Pat. No. 5,737,951 to Adam E. Krass describes a key turning device that facilitates turning a key in a keyhole of lock consisting of an elongated housing having distal and proximal ends. A receiving, unrestricted opening is formed within a housing and extends between the distal and proximal ends substantially along a longitudinal axis of the housing. At least one key is pivotally arranged at the proximal end of the housing.

In operation, the key is transverse to the housing and the key is turned in the keyhole of the lock by a force applied to the housing. An area of application of this turning force is distributed along and restricted by the received opening.

U.S. Pat. No. 5,794,471 to Frank Rizzo describes a holder for key including key turner. The holder has deployable wings and a chain for holding additional keys. The key is held in a central compartment of the holder by the urging of a key stop projection. The projection assists in holding the key-head during operation.

U.S. Pat. No. 6,164,102 to Bryan E. Gapco describes a key handle which is a bulbous hand grip that facilitates the turning of a key within a lock by increasing the turning radius through which the key is turned, as well as providing finger and hand surfaces which may be utilized during turning. The hand grip may include a substantially arculate or spheroidal surface contour. The key may be secured within the hand grip by elastic deformation forces and/or by conventional fasteners.

U.S. Pat. No. 5,732,447 to Nolen et al. describes a device that facilitates the buttoning and unbuttoning, as well as the zipping and unzipping, of clothing for individuals with limited manual dexterity. The device has an insertion component at one end for sliding into a buttonhole, a buttoner component at the other end in the form of a hook and an unbuttoner component therebetween.

U.S. Pat. No. 4,942,646 to Gabriel Sebastian describes a device formed from a one piece length of wire and includes a pair of wire members forming a short handle which then inclines downwardly and spreads apart and extends parallel to the handle and then converges and inclines upwardly at the closed ended tip component thereof. The closed ended tip is engaged through the button hole and over the button with the widest part spreading the button hole transversely thus enable the button to be pulled through easily whereupon the hole returns to its original elongated configuration and the device can be easily disengaged from the button. The stepped component spaces the handle clear of the shirt surface for ease of manipulation and eliminates distortion of the neck component of the shirt as it is used to engage the button through the button hole thereby eliminating strain on the button and preventing creasing from occurring.

U.S. Pat. No. 5,100,191 to Detrick et al. describes a zipper operating device for manipulating a slide fastener having a sliding operator member and a tab member connected to the sliding member. The zipper operating device includes a tang member, which may be received within a hole in the tab member whereby the zipper operating device may engage the sliding member for manipulation thereof. The zipper operating device is shaped generally like a key and includes a head component and a shank component extending therefrom. A hole is provided in the head component distal from the shank component such that the device may be attached to a key ring or key chain.

U.S. Pat. No. 5,500,966 to Alan Wheat describes a tool for facilitating the movement of a zipper including a handle, an arm connected to and extending transversely to a longitudinal axis of the handle, and a zipper flap receiving area formed in the arm at an end opposite the handle. The zipper flap receiving area serves to receive a zipper flap therein. The handle is integrally connected to the arm. The arm has a top surface, a bottom surface, a first side surface, and a second side surface. The zipper flap receiving area extends into the first side surface and through the arm from the top surface to the bottom surface. The zipper flap receiving area is a slot formed in the arm having an opening in the first side surface. The arm also has a tapered surface formed at an end opposite the handle.

U.S. Pat. No. 5,732,447 to Nolen et al. describes a device that facilitates the buttoning and unbuttoning, as well as the zipping and unzipping, of clothing for individuals with limited manual dexterity. The device has an insertion component at one end for sliding into a buttonhole, a buttoner component at the other end in the form of a hook and an unbuttoner component therebetween.

U.S. Pat. No. 4,067,487 to Carr et al. describes a combination zipper aid and shoehorn device wherein a conventionally shaped shoehorn for use by the individual in slipping shoes or similar footwear onto one's foot is provided with an opening on the narrow end of the shoehorn into which is retractably fitted a device for assisting in closing or opening zippers on one's apparel. The zipper aid consists of a length of cord material provided with a hook on one end, with the cord being spring wound onto a spool contained within a housing with the housing being retractable into the end of the shoehorn for storage thereof or out of the shoehorn so that the hook on the end of the cord can be attached to a zipper tab and, using the shoehorn as a handle, enabling an individual to readily open or close the zipper on one's garment.

U.S. Pat. No. 6,112,958 to LaMachhia et al. describes a combination bracelet, button, and zipper fastening device includes an elongated handle having a first end and a second end with a first releasable clamping means coupled to the first end and a removable, reversible end cap on the second end. The first releasable clamping means are operable to releasably hold at least one interlocking member of a releasable clasp of a bracelet. The removable, reversible end cap has a button hook and a chain attached to one end and an interlocking member on the other end. A second releasable clamping means is attached to the end of the chain. The handle is sized and configured to be held in a hand of a person so that the first clamping means is positioned to rest on a wrist adjoining the hand holding the handle so that a person using the bracelet fastening device can hold and position with one hand at least one interlocking member of the releasable clasp on the adjoining wrist while using the other free hand to fasten the other interlocking member of the clasp therewith to securely retain the bracelet around the wrist. The handle includes a hollow which is accessible from the second end and which is dimensioned to store the second clamping means, the chain, and the button hook.

As described in the patents above, many assist-devices exist to help manipulate small objects. In the case of key assistance devices described above, the key is generally fastened to the device or cannot readily adjust to various key-head sizes. Thus there remains a need for a general assist device that operates without generally having to fasten a key to the device and that can readily adjust to various key-head sizes. Moreover, there are small object devices with handles to facilitate buttoning and unbuttoning and zippering. The '447 device by Nolan et al. functions both to button and zip; however the bent component serves both purposes. An enclosed oblong loop with malleable wire such as provided in the present invention better serves the purpose of engaging various sizes of buttons. Also in the '447 device the wiry handle may be difficult to grasp. In the case of individuals who have problems gripping the handle there exists a need for a small object-manipulation assist device with a handle that will facilitate manipulation of buttons and zippers using not only one's entire hand but using one or more fingers. Combination devices exist for bracelet, button and zipper fastening, and zipper and shoehorn fastening. Yet no devices exist that combine zipping, buttoning and key manipulation. The small object manipulation device and method described here averts limitations in the prior art and provides an alternative device and method for persons with ailments affecting the hand to operate a key in a key-lock mechanism, to manipulate buttons and, and to use a zipper.

SUMMARY OF THE INVENTION

The present invention is directed to a device that assists persons with ailments affecting the hand to manipulate small objects. One aspect of the present invention is directed to a combination multi-small-object manipulation device for using and handling keys, buttons and zippers wherein the button/zipper assist interlocks into a key assist. Another aspect of the present invention is directed to a method for using the same.

These and other aspects of the present invention will become apparent to those skilled in the art after a reading of the following description of the preferred embodiment when considered with the drawings.

DETAILED DESCRIPTION OF THE PREFERRED EMBODIMENTS

Figure 1:
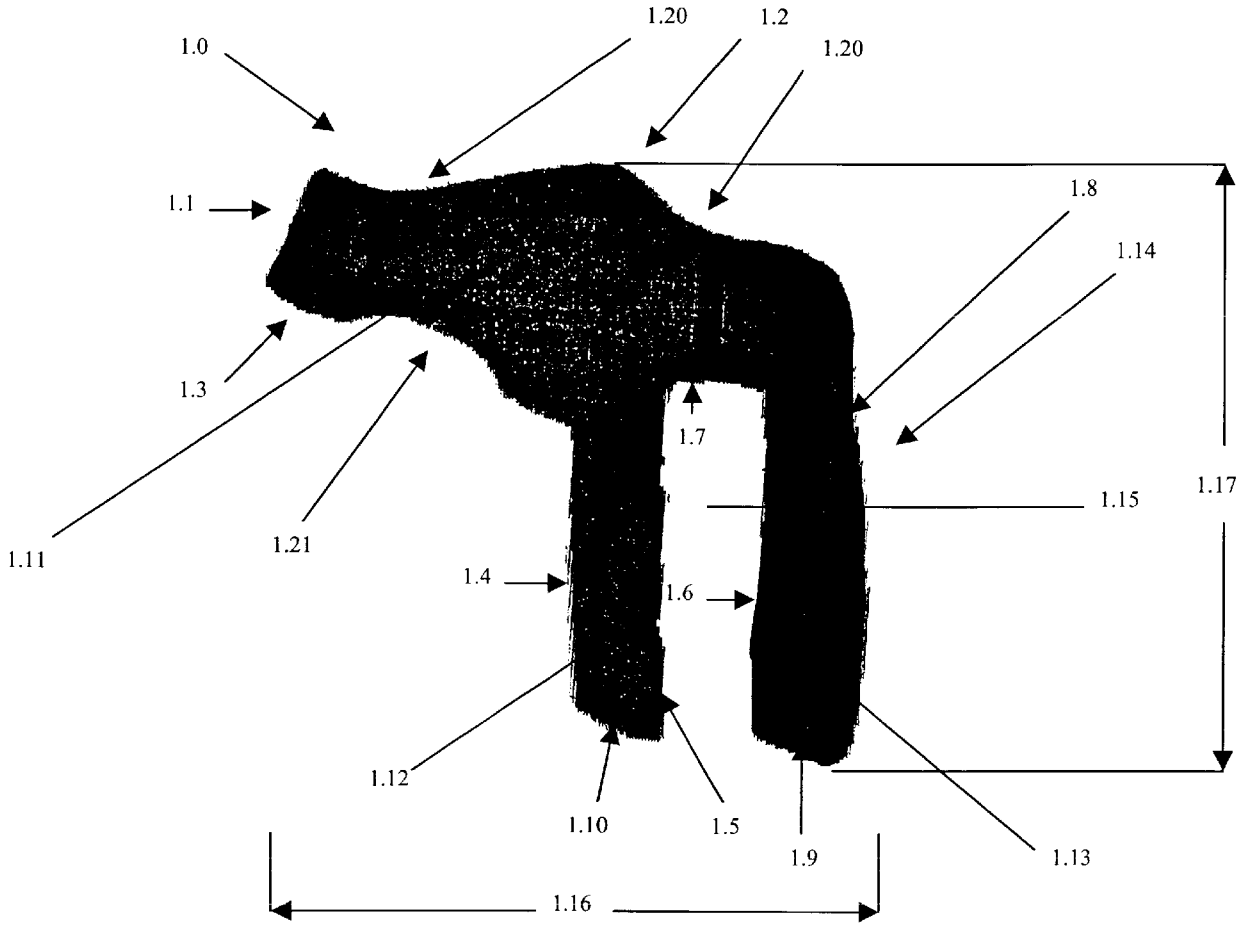
FIG. 1 is a front view of a basic regular embodiment of a key assist.

In the following description, like reference characters designate like or corresponding parts throughout the several views. Also in the following description, it is to be understood that such terms as "forward," "rearward," "front," "back," "right," "left," "upwardly," "downwardly," and the like are words of convenience and are not to be construed as limiting terms.

Referring now to the drawings in general, the illustrations are for the purpose of describing a preferred embodiment of the invention and are not intended to limit the invention thereto.

Figures 5A, 5B, 5C:
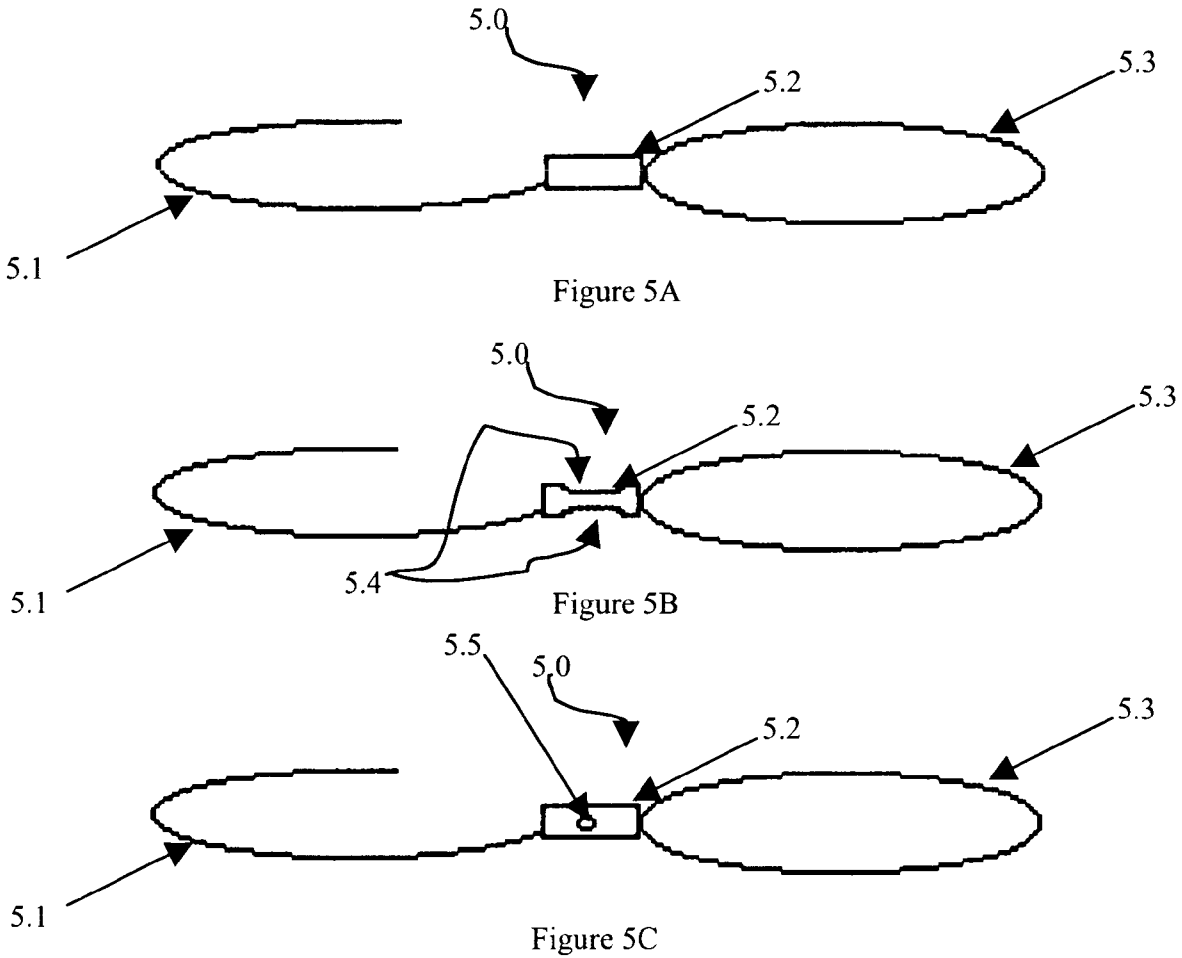
FIG. 5A is a front view of a preferred embodiment of the invention.
FIG. 5B is a front view of a more preferred embodiment of the invention.
FIG. 5C is a front view of another preferred embodiment of the invention.
Figure 6:
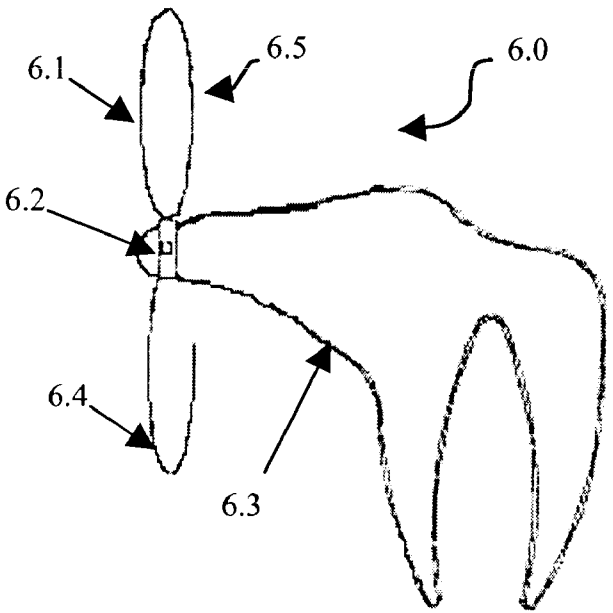
FIG. 6 is a front view of a preferred embodiment of a combination invention.

As shown in FIG. 6, the combination multi-small-object manipulation device is made of primarily two components, a combination button/zipper device 6.5, and a key assist device 6.3. A combination button/zipper device is independently shown in FIGS. 4A and 4B and 5A, 5B and 5C, and a key assist is independently shown in FIGS. 1 and 2A and 2B.

In a preferred embodiment as shown in FIG. 6, the connector piece 6.2 of the button/zipper assist device 6.5 releasably engages a key assist device 6.3. More preferably, the connector piece 6.2 of the button/zipper assist device slides or wedges into a slot cut out in the handle component 2.11, FIG. 2A, of the key assist device 6.3. In this embodiment the button/zipper assist device 6.5 may lie substantially in a plane perpendicular to the key assist 6.3. In another embodiment the connector component 5.2 as shown in FIG. 5C has an aperture 5.5 that aligns with the aperture 2.22 in the key assist device shown in FIG. 2A. Through the aligned apertures may be placed any string-like element. Preferably wire, cable, string, chain, etc or any combination thereof is placed through the aperture to hold the small-object manipulation device. This device is strategic because it can be used for manipulating keys, buttons and zippers and other such small-objects. In this preferred embodiment the button or zipper components can also serve to hang the device on a nail or some other such protrusion. The combination button/zipper assist may turn such that either the button component or zipper component inserts into the key assist device leaving the other component to serve as a hanging element. Additionally the button/zipper component may be releaseably insertable into the body portion of the combination device in a variety of locations, one of which is shown in FIG. 6.

In a preferred method of using the button/zipper-key assist device 6.0 as seen in FIG. 6, the device is used interchangeably as a button assist, a zipper assist and a key assist.

One aspect of the method provides for a user selecting the zipper assist device from the combination button/zipper assist device generally referred to as 6.5, engaging a zipper tab by inserting the open-looped zipper component 6.4 through a hole in the tab of a zipper, applying a force such as to move the zipper head connected to the zipper tab such as to open or close a zipper, and releasing the zipper tab by removing the zipper component 6.4 from the zipper tab hole.

Another aspect of the method provides for a user selecting the button assist device, inserting the button component 6.1 through a button hole, engaging a button using the button component 6.1, pulling the button through a button hole and disengaging or releasing the button from the button component 6.1 to complete the buttoning process.

Figure 2B:
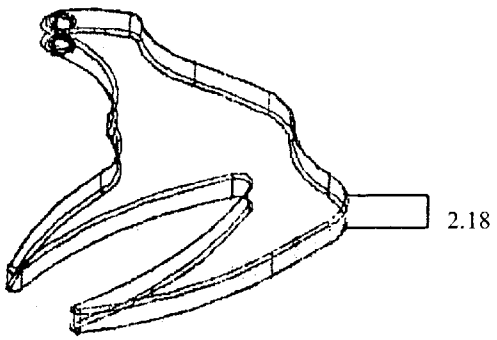
FIG. 2B is a perspective view of the embodiment illustrated in FIG. 2A.
Figure 2A:
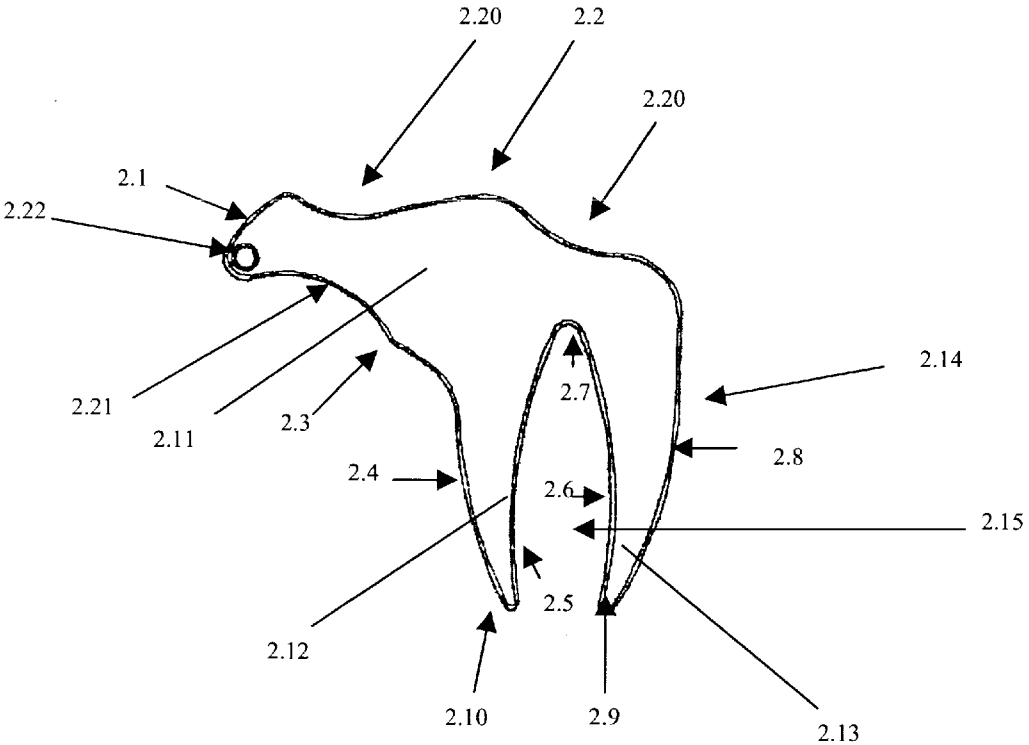
FIG. 2A is a front view of a preferable embodiment of a key assist.

Another aspect of the method provides for a user selecting to use the key assist device, and referring to FIGS. 1 and 2A, placing a key's head in the key compartment or key insertion area, 1.15 or 2.15 respectively, then placing fingers on the handle, 1.11 or 2.11 respectively, in the grooves 1.20 or 2.20 respectively, of the top side of the handle, 1.2 or 2.2 respectively, inserting the shank of the key into a lock, using the finger and twisting the wrist to apply torque or rotation R about a key inserted in the key gripping space 1.15 or 2.15 respectively, to the key-turning assist device such as to turn the key in the lock to open the lock. It is contemplated one or more fingers may be used to cause rotation R. One example of a use of the device is to open a lock with the use of only 1 finger in one groove 1.20 or 2.20 respectively.

A front view of a preferred embodiment of the basic or regular key assist device is shown in FIG. 1. The preferred embodiment generally referred to as 1.0 consists of an independent device that is not directly and permanently affixed to a single key. The device has a unitary body construction having a handle component 1.11 including three sides, 1.1, 1.2 and 1.3. Preferably, as shown in FIG. 2B, the device has a thickness 2.18 suitable for providing a stiffness for rotation of the device and a key, as well as for comfortable positioning of the fingers and thumb on the device. Preferably, sides 1.2 and 1.3 also have grooves 1.20 for finger placement and a thumb groove 1.21 for thumb placement for rotation R of the device about a key inserted in the key gripping space also referred to as the key compartment 1.15. Even more preferably there are discontinuities in the surface of the finger and thumb grip areas, 1.20 and 1.21, respectively, to improve finger gripping and to facilitate operation of the device.

A preferred embodiment also consists of a gripping component generally referred to as 1.14 comprised of an upper grip 1.13 and a lower grip 1.12. In a preferred embodiment the lower grip 1.12 consists of an outer side 1.4 and an inner side 1.5. In a preferred embodiment the upper grip 1.13 also consists of an outer side 1.8 and an inner side 1.6. The inner side 1.5 of the lower grip 1.12, the bottom side 1.7 of the key compartment, and the inner side 1.6 of the upper grip 1.13 together form a U-shaped groove or indentation in the key-turning assist device, which groove forms the key compartment 1.15. In a preferred embodiment the upper grip 1.12 and lower grip 1.13 move flexibly towards and away from each other adjustable to the size of the head of a key, which fits within the key compartment 1.15. The shank of the key will extend outward from the compartment 1.15. A preferred embodiment is about 2.5 inches in width 1.16 and about 2.5 inches in height 1.17.

A front view of a more preferred embodiment of the key assist device is shown in FIG. 2A. The embodiment generally referred to as 2.0 consists of a handle component 2.11 including three sides, 2.1, 2.2 and 2.3. Preferably, as shown in FIG. 2B, the device has a thickness 2.18 suitable for providing a stiffness for rotation of the device and a key, as well as for comfortable positioning of the fingers and thumb on the device. Preferably, sides 2.2 and 2.3 also have grooves 2.20 for finger placement and a thumb groove 2.21 for thumb placement for rotation R of the device about a key inserted in the key gripping space also referred to as the key compartment 2.15. Even more preferably there are discontinuities in the surface of the finger and thumb grip areas, 2.20 and 2.21, respectively, to improve finger gripping and to facilitate use of the device.

A preferred embodiment also consists of a gripping component generally referred to as 2.14 comprised of an upper grip 2.13 and a lower grip 2.12. Upper grip 2.13 tapers to a point 2.9. Lower grip 2.12 tapers to a point 2.10. In a preferred embodiment the lower grip 2.12 consists of an outer side 2.4 and an inner side 2.5. In a preferred embodiment the upper grip 2.13 also consists of an outer side 2.8 and an inner side 2.6. The inner side 2.5 of the lower grip 2.12, the bottom side 2.7 of the key compartment, and the inner side 2.6 of the upper grip 2.13 together form a V-shaped groove or indentation in the key-turning assist device, which groove forms the key compartment 2.15. Inner sides 2.5 and 2.6 meet generally at a point 2.7. That point may be curved or angular. In a preferred embodiment the upper grip 2.12 and lower grip 2.13 move flexibly towards and away from each other adjustable to the size of the head of a key, which fits within the key compartment 2.15. The shank of the key will extend outward form the compartment 2.15.

In a more preferred embodiment the key-turning assist device also has an aperture 2.22 for placing any string-like element through. Preferably wire, cable, string, chain, etc or any combination thereof is placed through the aperture to hold the key-turning assist device.

In the preferred embodiment the U shape or V-shaped key compartment is composed of upper and lower grips that may be referred to as pincers, claws, and/or prongs. The purpose of the upper and lower grips is to flexibly adjust in order to grab the head of a key. The sides of the grips may have may have discontinuities such as serrations, bumps, etc. to improve grip of the key-head in the key compartment. Preferably the lower and upper grips come together to grasp the head of the key such that the key head is securely placed within the key compartment.

A preferred embodiment is a key-turning assist device composed of plastic, rubber or other such materials. An assist device is that which provides the user a mechanical advantage when operating or manipulating an object. The assist device may be symmetric or asymmetric about its axis of rotation. The material that composes the preferred embodiment may vary in hardness, but a high coefficient of friction to enable easy grasping of the assist device is usually desirable. A more preferred embodiment is a plastic key-turning assist device with rubber comfort points strategically placed where fingers contact the key-turning assist device. Such rubber comforts are placed to cushion the fingers on the assist device. In an even more preferred embodiment of the key-turning assist device the handle is ergonomically contoured. Preferably the body, handle and grip of the key-turning assist device is unitary, one complete unity. Unitary means the object is continuous and whole. However, segmented key-turning assist devices are also contemplated with parts that joinably fasten as to create a similarly functioning key-turning assist device.

Referring to FIGS. 1 and 2A, a preferred embodiment of the method is placing a key's head in the key compartment or key insertion area, 1.15 or 2.15 respectively, then placing fingers on the handle, 1.11 or 2.11 respectively, in the grooves 1.20 or 2.20 respectively, of the top side of the handle, 1.2 or 2.2 respectively, inserting the shank of the key into a lock, using the finger and twisting the wrist to apply torque or rotation R about a key inserted in the key gripping space 1.15 or 2.15 respectively, to the key-turning assist device such as to turn the key in the lock to open the lock. It is contemplated one or more fingers may be used to cause rotation R. One example of a use of the device is to open a lock with the use of only 1 finger in one groove 1.20 or 2.20 respectively.

Referring to FIGS. 1 and 2A, a more preferred embodiment of the method is placing a key's head in the key compartment, 1.15 or 2.15 respectively, then placing a finger, preferably the index finger, on the handle, 1.11 or 2.11 respectively, in the grooves, 1.20 or 2.20 respectively, of the top side of the handle, 1.2 or 2.2 respectively, placing a second finger, preferably a thumb, in the groove 1.21 or 2.21 respectively, on the lower side of the handle, 1.3 or 2.3 respectively, inserting the shank of the key into a lock, using the index finger and thumb and twisting the wrist to apply torque or rotation R about a key inserted in the key gripping space 1.15 or 2.15 respectively, to the key-turning assist device such as to turn the key in the lock to open the lock.

The key-turning assist device increases the turning radius for an individual with ailments that make it difficult to handle a key to operate a lock and key device. The invention described above facilitates this process by allowing the operator to use one or more fingers to turn the key. A variety of physical ailments can reduce the ability of a key user to exert sufficient torque on the key in order to rotate the lock cylinder, such as carpal-tunnel syndrome, Charcot-Marie-Tooth disease, wrist and forearm fractures, birth defects, amputees, wearing casts, multiple sclerosis, muscular dystrophy, cerebral palsy, quadriplegia, etc.

Figure 4A:
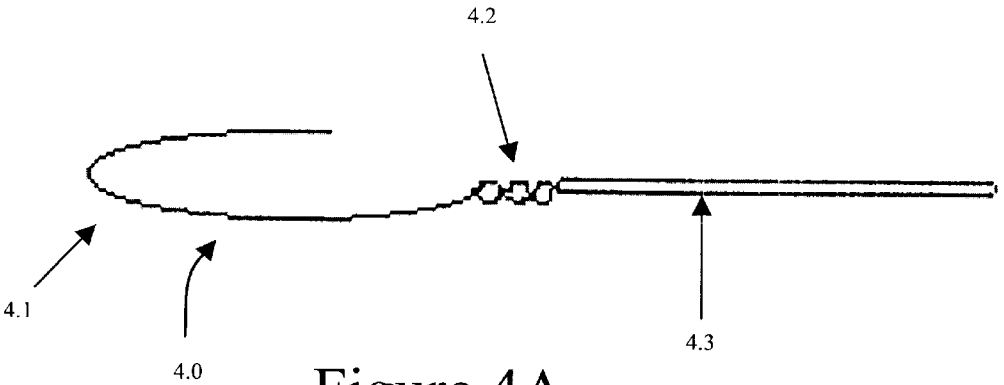
FIG. 4A is a front view of an embodiment of the invention.
Figure 4B:
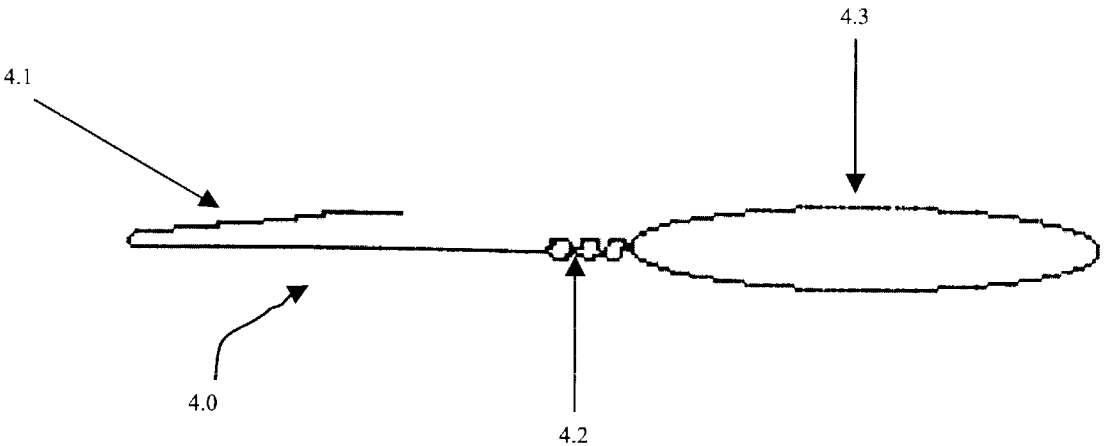
FIG. 4B is a perspective view of an embodiment illustrated in FIG. 4A.

A front view of a preferred embodiment of a basic or regular button assist device is shown in FIG. 4A and 4B. The preferred embodiment generally referred to as 4.0 composed of three pieces, a substantially bent or hooked zipper component 4.1 used to engage zipper tabs, a button component 4.3 used to engage buttons and the connector component 4.2 connecting the zipper component 4.1 to the button component. Substantially bent includes bent or any angle or turn of the zipper component 4.1 to adequately engage a zipper tab. In a preferred embodiment, the button/zipper device is entirely unitary. Unitary means it is a single continuous piece of string-like metal or plastic. In another preferred embodiment the device is segmented. Segmented means the button, connector and zipper components are different pieces connected by means such as gluing, screwing or welding or any other connecting means. In another preferred embodiment the button and zipper components are made of either plastic or metal. Metal includes soft stainless steel wire but is not limited thereto. In a preferred embodiment the soft stainless steel wire may be shaped for different sizes of buttons or different zipper tab holes.

A preferred length for the button/zipper assist device is about three to about six inches. However the device may be constructed of various lengths and widths. The bent part of the zipper component may be fashioned as to engage various sizes of zipper tabs and holes of zipper tabs.

As seen in FIG. 5A, in another preferred embodiment, the connector component 5.2 may serve as a handle that is any shape such as a rectangular block or cylinder. It may be dowel-like. The connector may be plastic, metal, stone, wood or any other hard substance. The connector may be made of a malleable substance such as cork to form to a particular user's fingers. As seen in FIG. 5B the connector component 5.2 may have finger grooves 5.4 for ergonomic comfort. The finger grooves may have rubber comfort points. The connector component may be of various sizes. As seen in FIG. 5C the connector component 5.2 may be fashioned such that it is releasably engaged or interlocked.

Through the aperture may be placed any string-like element. Preferably wire, cable, string, chain, etc or any combination thereof is placed through the aperture to hold the small-object manipulation device. This device is strategic because it can be used for manipulating buttons and zippers and other such small-objects. In this preferred embodiment the button or zipper components can also serve to hang the device on a nail or some other such protrusion.

In a preferred method of using the button/zipper device as seen in FIGS. 4A and 4B the zipper component 4.1 is used as a handle for the button component 4.3 and the device serves as a button assist. The method provides for a user inserting a finger in the substantially bent component of the zipper component, inserting the button component through a button hole, engaging a button using the button component, pulling the button through a button hole and disengaging or releasing the button to complete the buttoning process. The bent handle allows one to grasp the button-device using not only the entire hand, but also one or more fingers.

In another preferred method of using the button/zipper assist device as seen in FIGS. 4A and 4B the button component 4.3 is used as a handle for the zipper component 4.1 and the device serves as a zipper-assist. The method provides for a user inserting a finger through the open loop handle which is the button component 4.3, engaging a zipper tab by inserting the open-looped zipper component 4.1 through a hole in the tab of a zipper, applying a force such as to move the zipper head connected to the zipper tab such as to open or close a zipper, and releasing the zipper tab by removing the open-looped zipper component 4.1 from the zipper tab hole. The oblongly looped button component 4.3 serving as a handle permits one to grasp the zipper-device using not only the entire hand, but also one or more fingers.

In a more preferred method of using the button/zipper assist device as seen in FIG. 5A and 5B the connector component 5.2 is used as a handle for both the zipper component and the button component. One aspect of the method provides for a user holding the connector 5.2 with at least two fingers, engaging a zipper tab by inserting the open-looped zipper component 5.1 through a hole in the tab of a zipper, applying a force such as to move the zipper head connected to the zipper tab such as to open or close a zipper, and releasing the zipper tab by removing the open-looped zipper component 5.1 from the zipper tab hole. Another aspect of the method provides for a user holding the connector 5.2 with at least two fingers, inserting the oblongly looped button component 5.3 through a button hole, engaging a button using the button component 5.3, pulling the button through a button hole and disengaging or releasing the button from the button component 5.3 to complete the buttoning process.

Thus, a method of using the device according to the present invention includes the following steps:

(a) providing a button or zipper and a button/zipper assist device having a connector component having an oblong looped button component affixed to a first end of the device and an open-looped zipper component affixed to a second end of the device;

(b) providing a corresponding button hole or a zipper tab hole on a zipper;

(c) using the connector component of the device as a handle;

(d) holding the connector component with at least two fingers;

(e) inserting the oblong looped button component through the button hole or inserting the open-looped zipper component through the zipper head hole;

(f) engaging the button using the button component or engaging the zipper head with the open-looped zipper component;

(g) pulling the button through the button hole or moving the zipper using the zipper component; and (h) disengaging the button from the button component or disengaging the zipper head from the zipper component to complete the buttoning process or zipping process, respectively. Also, according to the present invention, the steps are reversed to unbutton or to unzip the button or the zipper, respectively.

The button/zipper assist device facilitates handling a button for an individual with ailments that make it difficult to manipulate buttons and operate zippers. The invention described above facilitates both processes by creating one device, which an operator can use with one or more fingers to grasp a button and insert the button through a button-hole.

In another preferred embodiment the device also has an aperture for placing any string-like element through. Preferably wire, cable, string, chain, etc or any combination thereof is placed through the aperture to hold the key-tuning assist device. Notably, the aperture may be located in other positions on the body of the device, depending upon the type of connector or holder used, e.g., key ring, key bar, etc.

Certain modifications and improvements will occur to those skilled in the art upon a reading of the foregoing description. By way of example, the device according the present invention may be modified for select, predetermined target users, such as small children or the elderly, who have difficulty manipulating small objects, like buttons and zippers. For children, the device would be modified with a larger connector portion or handle and protective end coverings or a latch on the zipper loop, which provides for increased safety of use. All modifications and improvements have been deleted herein for the sake of conciseness and readability but are properly within the scope of the following claims.

We claim:

1. A combination key/button/zipper assist device comprising:

(a) a button/zipper assist device including
  1)an open-looped zipper component used for engaging zipper tabs, and button tabs; and
  2) an oblong looped button component used for engaging buttons;
  3) said zipper component and said button component joined together by a connector component; and (b) a key assist device further comprising
  1) a handle component; and
  2) a key-gripping component for aiding persons with manipulating keys in a key and lock device;

(c) said button/zipper assist device releasably engaged to said key assist device.

2. The combination key/button/zipper assist device according to claim 1 wherein said connector component of the button/zipper assist device slides into a slot cut out in said handle component of said key assist device.

3. The combination key/button/zipper assist device according to claim 1 wherein an aperture in said connector component of the button/zipper assist device aligns with an aperture in said handle component of said key assist device to allow for elements to pass through said apertures.

4. A method for using a combination key/button/zipper assist device comprising the following steps:

(a) providing a key/button/zipper assist device wherein the button and zipper assist portion is releasable engaged with the key assist device;

(b) selecting a button assist device from the combination button/zipper assist device;

(c) providing a button;

(d) providing a corresponding button hole;

(e) using the connector component as a handle;

(f) holding the connector component with at least two fingers;

(g) inserting the oblongly looped button component through a button hole;

(h) engaging a button using the button component;

(i) pulling the button through a button hole; and (j) disengaging the button from the button component to complete the buttoning process.

5. A method for using a combination key/button/zipper assist device comprising the following steps:

(a) providing a key/button/zipper assist device wherein the button and zipper assist portion is releasably engaged with the key assist device;

(b) selecting the zipper-assist device from the combination button/zipper assist device;

(c) using the connector component as a handle;

(d) holding the connector component of a button/zipper assist device with at least two fingers;

(e) engaging a zipper tab by inserting the open-looped zipper component through a hole in the tab of a zipper;

(f) applying a force such as to move the zipper head connected to the zipper tab such as to open or close a zipper (g) releasing the zipper tab by removing the open-looped zipper component from the zipper tab hole.

6. A method for using a combination key/button/zipper assist device comprising the following steps:

(a) providing a key/button/zipper assist device wherein the button and zipper assist portion is releasably engaged with the key assist device;

(b) selecting the key assist device from the combination button/zipper assist device;

(c) placing a key's head in the key compartment or key insertion area (d) placing one or more fingers on the handle (e) inserting the shank of the key into a lock (f) twisting the wrist to apply torque or rotation R about a key inserted in the key gripping space to the key-turning assist device such as to turn the key in the lock to open the lock.

* * * * *